United States Patent [19]

Naffrechoux et al.

[11] Patent Number: 4,541,203

[45] Date of Patent: Sep. 17, 1985

[54] OVEN DOOR GASKET

[75] Inventors: Etienne Naffrechoux, Crepy en Valois; Thierry Delfosse, Neuilly, both of France

[73] Assignee: Raychem Corp., Menlo Park, Calif.

[21] Appl. No.: 521,868

[22] Filed: Aug. 10, 1983

Related U.S. Application Data

[63] Continuation of Ser. No. 206,811, Nov. 14, 1980.

[51] Int. Cl.[4] ..... E06B 7/16

[52] U.S. Cl. ..... 49/485; 126/200; 49/475

[58] Field of Search ..... 49/475, 488, 500; 126/200; 52/398, 399

[56] References Cited

U.S. PATENT DOCUMENTS

| | | | |
|---|---|---|---|
| 3,200,812 | 8/1965 | Larkin | 126/200 |
| 3,408,785 | 11/1968 | Kochanowski | 126/200 X |
| 4,084,348 | 4/1978 | Hast | 49/475 |

*Primary Examiner*—Kenneth Downey

*Attorney, Agent, or Firm*—T. Gene Dillahunty; Herbert G. Burkard

[57] ABSTRACT

A gasket arrangement for a two-panel door or observation window of a high temperture oven has, preferably, two gaskets disposed one on each side of one panel of the door or window around its periphery so as to provide a seal between the panels and to allow sealing of the door or window against a further member, for example frame, of the oven. A layer of vapor impermeable material extends between the gaskets so as to prevent escape of fumes from the oven. The gaskets are preferably of glass fibre, and the vapor impermeable material a metallic foil.

5 Claims, 5 Drawing Figures

OVEN DOOR GASKET

This application is a continuation of application Ser. No. 206,811 filed Nov. 14, 1980.

BACKGROUND OF THE INVENTION

This invention relates to an oven door gasket arrangement and to ovens using the same.

The invention finds particular, though not exclusive, application as a double gasket arrangement, which can be used in ovens having a pair of glass observation windows or doors. Such double gasket arrangements are usually fitted so as to dispose respective gaskets in front of and behind an inner glass door that is situated between the oven interior and an outer glass door. One gasket of the arrangement is positioned to close the inner glass door against part of the oven, e.g. a surrounding part of the metal oven door, and the other gasket is positioned to close the edges of the cavity between the inner glass door and the outer glass door.

SUMMARY OF THE INVENTION

The present invention provides a gasket arrangement for ovens, comprising at least one gasket and at least one layer of substantially vapour impermeable material arranged so as substantially to prevent fumes generated within the oven in use from passing through said at least one gasket.

The oven member on which th e gasket arrangement is to be mounted will generally be a glass door or window. Preferably, the gasket arrangement comprises two of said gaskets, said gaskets being elongate and aligned substantially parallel to each other and connected together so as to be positionable, in use, at an edge of a substantially planar oven member on opposite sides thereof.

The arrangement of the present invention has the advantage that the vapour impermeable layer can be used to keep the fumes out of the cavity between the said oven member and the oven component against which the outer gasket is pressed. This is particularly advantageous in ovens having a pair of glass windows or doors, wherein the vapour impermeable layer may be arranged to prevent ingress of fumes into the cavity between the two glass windows or doors, thus alleviating a long-standing problem of contamination between the two glass doors or windows, where cleaning may be difficult or impossible, especially when the windows are fixed in the oven door itself.

Preferably the vapour impermeable layer extends across the full width of the double gasket arrangement in such a manner as to seal not only the cavity between the glass plates or other oven members, but also the line of contact between the inner glass plate and the surrounding metal of the oven door, thus substantially preventing the fumes from passing from the oven interior into the interior of the door. It is envisaged that only one or other of these seals may be effected by the impermeable material in some embodiments of the invention, and it is also envisaged that the inner gasket will be disposed between the glass windows or doors and that the outer gasket will be disposed outside the outer glass window or door. However, it is preferred that at least the cavity between the glass plates be sealed by the impermeable material.

In another embodiment, the gasket arrangement comprises three, or more, gaskets, all of which are interconnected by one or more layers of vapour-impermeable material for fume-sealing purposes.

The impermeable layer may itself be the material which physically connects and holds together the gaskets of the arrangement, but it is preferred that the connecting function be performed by a suitable strong and heat resistant web, such as a glass reinforced tape, which may contain adhesive. In the latter case, the gaskets may be attached (preferably by sewing) along the opposite edges of the tape and any adhesive which remains exposed between the gaskets can be conveniently used to assist in attaching the gasket arrangement to the edge of the relevant glass plate. In this preferred arrangement, the impermeable layer may be carried on the surface of the tape which is remote from the adhesive and gaskets and should extend far enough, if necessary partly around the gaskets, to ensure an adequate vapour seal.

The impermeable layer may alternatively be carried on the adhesive surface of the tape, this arrangement having the advantage that the adhesive is protected from direct exposure to the gasketed cavity, thus reducing the risk of any fumes generated by the adhesive at high temperatures contaminating that cavity. The impermeable layer may extend across the adhesive surface underlying the gasket since sewing is preferably used to attach the gaskets firmly to the connecting tape/impermeable material laminate. An alternative arrangement is for the impermeable layer to cover the adhesive where it is not in contact with the gaskets and to wrap around the perimeter of the gaskets so as to leave them in contact with the adhesive where necessary for attachment to the tape. This implies adequate adhesive strength, and adequate flexibility of the impermeable layer, to maintain the gasketing function.

Combinations of impermeable layers on the adhesive and non-adhesive sides of the tape can also be used, and it may be desirable to leave exposed a small central area of adhesive for use in attaching the gasket to the glass panel edge as aforesaid. The preferred gasketing material is a fibrous material, such as glass fibre or ceramic fibre or silica fibre for high temperature ovens in which the present invention is particularly advantageous, and the preferred impermeable material is metallic foil or a layer of vacuum deposited metal.

The gaskets of the arrangement may be connected together by sewing rather than by a tape as referred to above.

OBJECTS OF THE INVENTION

It is an object of the invention to provide a gasket arrangement that provides an improved closure.

It is a further object of the invention to provide a gasket arrangement that effects a good seal with an oven door, and that is easy to instal.

It is a still further object of the invention to provide a gasket arrangement construction that is conveniently modifiable so as to provide an arrangement having two or three, or more, gaskets.

DESCRIPTION OF THE DRAWINGS

Specific embodiments of the invention will now be described by way of example with reference to the accompanying drawing wherein.

DESCRIPTION OF THE PREFERRED EMBODIMENT

Figure 1:
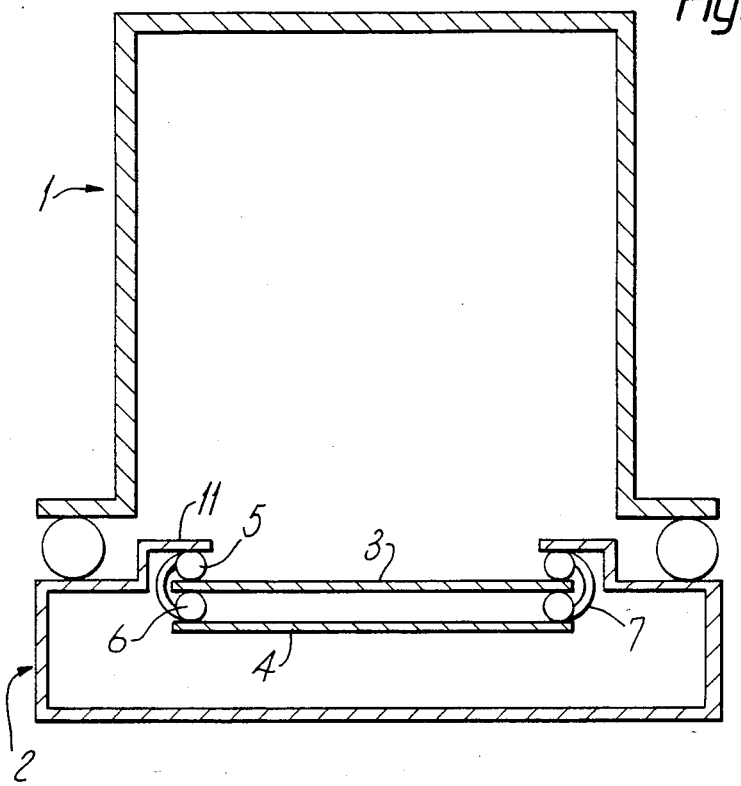
FIG. 1 shows schematically a horizontal section through an oven having a door incorporating a gasket arrangement according to the present invention.

Referring to FIG. 1, an oven 1 has a door 2, in which are mounted two glass observation panels 3 and 4. The inner panel 3 is gasketed against the metal oven door surround 11 by an inner gasket 5, which is connected to an outer gasket 6 on the opposite side of the panel 3 by a connecting strip 7. The outer gasket 6 thus provides a gasket closure around the edges of the cavity between the glass panels 3 and 4.

Figure 2:
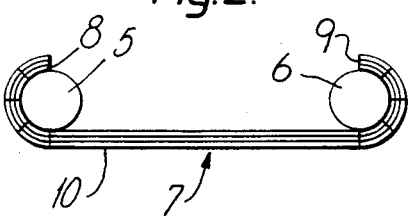
FIG. 2 shows in greater detail the gasket arrangement of FIG. 1.
Figure 3:
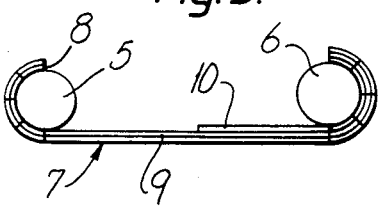
FIGS. 3, 4 and 5 show alternative forms of gasket arrangement according to the present invention.

The connecting strip 7 can be seen in more detail in FIG. 2, which shows the gaskets 5 and 6 sewn to a layer of adhesive 8 carried by a glass reinforced tape backing 9. A substantially vapour impermeable layer 10 of the gasket arrangement is formed from a metal foil or vapour deposited metal. In FIG. 2, the vapour impermeable layer is on the surface of the adhesive tape remote from the adhesive. FIG. 3 shows an alternative construction of the gasket arrangement, in which the vapour impermeable layer 10 is disposed on the adhesive surface of the connecting tape, in such a position as to seal at least the cavity between the glass plates against ingress of fumes generated within the oven in use. The arrangement of FIG. 3 also reduces the likelihood of adhesive 8 producing fumes within the cavity between the glass panels 3 and 4, while leaving some of the adhesive 8 exosed to assist attachment of the gasket arrangement to the edge of the glass plate.

Figure 4:
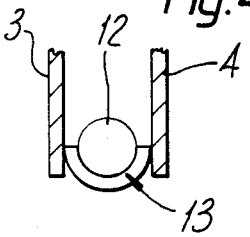
Figure 5:
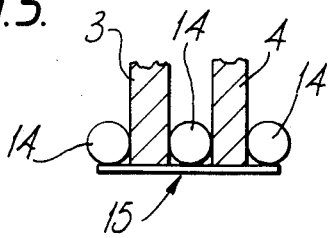

The alternative gasket arrangement shown schematically in FIG. 4 employs only one gasket 12 in combination with vapour impermeable material contained within a connecting strip 13. The further alternative arrangement of FIG. 5 has three gaskets 14 interconnected by a single connecting strip 15 incorporating the vapour sealing material.

In the illustrated case, the glass panels are substantially permanently mounted within the door 2, but it is envisaged that the panels 3 and 4 could themselves be doors or windows that are hinged or otherwise movable to form an openable construction, which would nevertheless be gasketed in the same way when the glass doors thus constructed were closed to correspond to the position shown in FIG. 1.

Other constructions and combinations of impermeable layers can readily be designed to suit specific constructions. The preferred gasketing material is glass or ceramic or silica fibre for high temperature ovens, but other materials may be used if desired.

From the foregoing detailled description, it will be evident that changes, adaptations and modifications may be made by those skilled in the art, which are considered to fall within the scope of the present invention. It is intended that all such variations not departing from the spirit of the invention be considered as within the scope thereof as defined by the appended claims.

What is claimed is:

1. A gasket arrangement suitable for use in an oven, comprising: (a) at least two discrete, elongate, fibrous gaskets that are aligned substantially parallel to each other and connected together, the first of said gaskets being positionable, in use, to seal a gap between two substantially planar members of the oven; and (b) a vapour impermeable metal layer arranged to at least partly surround the first of said gaskets and extend therefrom towards another of said gaskets and to thereby prevent fumes generated within the oven from penetrating the first gasket.

2. A gasket arrangement according to claim 1, wherein the gaskets are connected to each other by adhesive tape, and lie substantially parallel to the tape edges.

3. A gasket arrangement according to claim 2, wherein the vapour impermeable material is carried either on the surface of the tape which is remote from the adhesive carrying surface thereof, or is carried on the adhesive of the tape.

4. A gasket arrangement according to claim 3, wherein the impermeable material extends only part way across the adhesive between the gaskets.

5. A sealing arrangement, comprising substantially planar door or window member of an oven, the member having (a) two discrete, elongate, fibrous gaskets that are connected together positioned at an edge of said member with said gaskets on opposite sides of said member and (b) a vapour impermeable metal layer arranged to at least partly surround the first of said gaskets and extend therefrom towards the second said gasket and to thereby prevent fumes generated within the oven from penetrating the first gasket.

* * * * *